US007555875B2

(12) United States Patent
Kim

(10) Patent No.: US 7,555,875 B2
(45) Date of Patent: Jul. 7, 2009

(54) MEDICINE MANAGEMENT SYSTEM AND PROCESSING METHOD THEREOF

(75) Inventor: Jun Ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 0 days.

(21) Appl. No.: 11/716,390

(22) Filed: Mar. 9, 2007

(65) Prior Publication Data

US 2008/0115456 A1 May 22, 2008

(30) Foreign Application Priority Data

Nov. 20, 2006 (KR) ..... 10-2006-0114636

(51) Int. Cl.
*B65B 35/54* (2006.01)

(52) U.S. Cl. ..... 53/154; 53/55; 53/493; 221/9

(58) Field of Classification Search ..... 53/154, 53/237, 55, 473, 493; 221/92, 123, 124, 221/133, 2, 7, 9
See application file for complete search history.

(56) References Cited

U.S. PATENT DOCUMENTS 5,597,995 A * 1/1997 Williams et al. ..... 235/375
5,709,063 A 1/1998 Yuyama et al.
5,771,657 A * 6/1998 Lasher et al. ..... 53/55
5,880,443 A * 3/1999 McDonald et al. ..... 235/375
5,930,145 A * 7/1999 Yuyama et al. ..... 700/231
6,006,946 A * 12/1999 Williams et al. ..... 221/9
6,112,502 A * 9/2000 Frederick et al. ..... 53/411
6,742,671 B2 * 6/2004 Hebron et al. ..... 221/9
7,249,688 B2 * 7/2007 Hunter et al. ..... 221/79
7,308,338 B2 * 12/2007 Guerra ..... 700/245
2001/0002448 A1 * 5/2001 Wilson et al. ..... 700/233
2006/0259195 A1 * 11/2006 Eliuk et al. ..... 700/245
2007/0169838 A1 * 7/2007 Yuyama et al. ..... 141/107

FOREIGN PATENT DOCUMENTS

JP 2004345837 A 12/2004
JP 2005211540 8/2005
JP 2006230763 A 9/2006

* cited by examiner

*Primary Examiner*—Thanh K Truong
(74) *Attorney, Agent, or Firm*—Seed IP Law Group PLLC

(57) ABSTRACT

A medicine management system includes a medicine storage unit, keeping at least one new cassette in which medicines are accommodated; a robot unit including a gripper for gripping the new cassette; an automatic medicine packing apparatus, dispensing and packing medicines from a dispensing cassette thereof, and requesting replenishment of medicines when there is no medicine in the dispensing cassette; and a central control unit, controlling the robot unit to transmit movement control commands to the robot unit upon receiving the replenishment request, to mobilize the robot unit to transfer the empty dispensing cassette to a conveyer and gripping a new cassette in which the corresponding medicines are accommodated from the medicine storage unit and mounted to the automatic medicine packing apparatus.

11 Claims, 7 Drawing Sheets

MEDICINE MANAGEMENT SYSTEM AND PROCESSING METHOD THEREOF

BACKGROUND OF THE INVENTION

1. Field of the Invention

The present invention relates to a medicine management system and a processing method thereof, and more particularly, to a medicine management system and a processing method thereof, in which using a robot unit, the replenishment of medicines is conveniently implemented by moving an empty cassette of an automatic medicine packing apparatus and then mounting the automatic medicine packing apparatus with a new cassette which is kept in a medicine storage unit and in which the corresponding medicines are accommodated.

2. Description of the Related Art

Generally, an automatic medicine packing apparatus is an apparatus which is equipped in a hospital or pharmacy to automatically pack medicines as a dose dispensed by a pharmacist according to each prescription.

Such an automatic medicine packing apparatus automatically discharges the medicines prescribed according to respective diseases of patients, and then packs the discharged medicines dose by dose. The automatic medicine packing apparatus is designed so that a plurality of medicine cassettes, which have various medicines, respectively, are arranged in and mounted to a plurality of cassette supports (hereinafter, referred to as "cartridges"), the medicine cassettes mounted to the cartridges are intermittently controlled, respectively, the medicines prescribed dose by dose are discharged downwards through respective passages formed in the cartridges, the medicines discharged from the cartridges are collected to a hopper, and the medicines collected to the hopper are discharged to the bottom side of the hopper and thus tightly packed by packing means and packing paper.

However, in this automatic medicine packing apparatus described above, if all the medicines which are accommodated in one of the plurality of cassettes are used up, a pharmacist or manager should directly find the same medicines as those put in the cassette and fill the corresponding cassette with the corresponding medicines, which is inconvenient.

Furthermore, there is also a disadvantage in that a pharmacist or manager should check one by one the stock of the medicines to be filled in the cassette of the automatic medicine packing apparatus.

BRIEF SUMMARY OF THE INVENTION

An object of the present invention is to provide a medicine management system and a processing method thereof, in which using a robot unit, the replenishment of medicines is conveniently implemented by moving an empty cassette of an automatic medicine packing apparatus and then mounting the automatic medicine packing apparatus with a new cassette which is kept in a medicine storage unit and in which the corresponding medicines are accommodated.

Another object of the present invention is to provide a medicine management system and a processing method thereof capable of conveniently checking the stock which is kept in a medicine storage unit after the cassette which is kept in the medicine storage unit and in which the medicines are accommodated is delivered to the automatic medicine packing apparatus.

According to an aspect of the present invention, there is provided a medicine management system, comprising: a medicine storage unit for keeping at least one cassette in which medicines are accommodated; a robot unit moving along a predetermined robot movement line and including a gripper for gripping the cassette; an automatic medicine packing apparatus for packing medicines according to a preparation request data externally received and for requesting replenishment of medicines when there is no medicine in the cassette; and a central control unit for controlling the robot unit to transmit movement control commands to the robot unit when the automatic medicine packing apparatus requests the cassette to be replenished with the medicines so that the cassette requested to be replenished with the medicines is gripped in the automatic medicine packing apparatus and transferred to a conveyer and a new cassette in which the corresponding medicines are accommodated is gripped in the medicine storage unit and mounted to the automatic medicine packing apparatus.

In one embodiment, a bar code for representing medicine information and cassette identification information is attached to the cassette.

In one embodiment, the central control unit includes a storage portion for storing medicine information on the medicines which are kept in the medicine storage unit and cassette identification information on the cassette in which the medicines are accommodated; an interface portion communicating with the automatic medicine packing apparatus, the medicine storage unit and the robot unit; a receipt processing portion for receiving a medicine replenishing request signal from the automatic medicine packing apparatus; a retrieval portion for retrieving the cassette information on the cassette, in which the corresponding medicines are accommodated, from the storage portion according to the received medicine replenishing request signal; and a transmission processing portion for transmitting the movement control commands, including the cassette information on the cassette requested to be replenished with the medicines, the cassette information on the cassette retrieved from the storage portion, and conveyer position information, to the robot unit through the interface portion.

In one embodiment, the central control unit further includes an update processing portion for updating the storage portion with new cassette identification information on the cassette to be mounted according to the medicine replenishing request of the automatic medicine packing apparatus.

In one embodiment, the central control unit further includes a stock checking portion for checking a stock of the medicine storage unit after the new cassette in which the medicines are accommodated and which is kept in the medicine storage unit is mounted to the automatic medicine packing apparatus through the robot unit.

In one embodiment, the automatic medicine packing apparatus includes a determining portion for determining whether or not there are medicines in the cassette; and a transmission processing portion for generating the medicine replenishing request signal and transmitting it to the central control unit through the interface portion when there is no medicine in the cassette.

In one embodiment, the medicine management system further comprises a reader for reading the bar code, wherein the central control unit receives and displays the medicine and cassette identification information on the bar code read by the reader.

According to another aspect of the present invention, there is provided a processing method of the medicine management system, comprising the steps of: receiving a medicine replenishing request signal from the automatic medicine packing apparatus; retrieving cassette information on a cassette, in which the corresponding medicines are accommodated, from the storage portion according to the received medicine replenishing request signal; and transmitting movement control commands, including cassette information on the cassette requested to be replenished with the medicines, cassette information on the cassette retrieved from the storage portion, and conveyer position information, to the robot unit.

In one embodiment, the processing method further comprises the step of updating the storage portion with cassette identification information on the new cassette to be mounted according to the medicine replenishing request of the automatic medicine packing apparatus.

In one embodiment, after the transmitting step, the processing method further comprises the steps of receiving a medicine replenishing completion signal after the cassette in which the corresponding medicines are accommodated and which is kept in the medicine storage unit is transferred to the automatic medicine packing apparatus through the robot unit; and checking a stock of the medicine storage unit according to the received medicine replenishing completion signal.

According to a further aspect of the present invention, there is provided an operation processing method of the robot unit in the medicine management system, comprising the steps of: receiving movement control commands, including cassette information on a cassette requested to be replenished with medicines, conveyer position information on a conveyor, and new cassette information on a new cassette in which the corresponding medicines are accommodated and which is kept in the medicine storage unit, from the central control unit; moving to the automatic medicine packing apparatus using the cassette information on the cassette requested to be replenished with the medicines among the received movement control commands; gripping the cassette requested to be replenished with the medicines from the automatic medicine packing apparatus; transferring the gripped cassette to the conveyer using the conveyer position information among the movement control commands; moving to the medicine storage unit along a predetermined robot movement line; gripping the new cassette from the medicine storage unit using the new cassette information among the movement control commands; and moving along a robot movement line to the automatic medicine packing apparatus; and mounting the gripped new cassette to the automatic medicine packing apparatus.

BRIEF DESCRIPTION OF THE SEVERAL VIEWS OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

Hereinafter, a preferred embodiment of the present invention will be described in detail with reference to the accompanying drawings.

A medicine management system according to an embodiment of the present invention will be described in detail referring to FIGS. 1 to 5 as follows.

Figure 1:
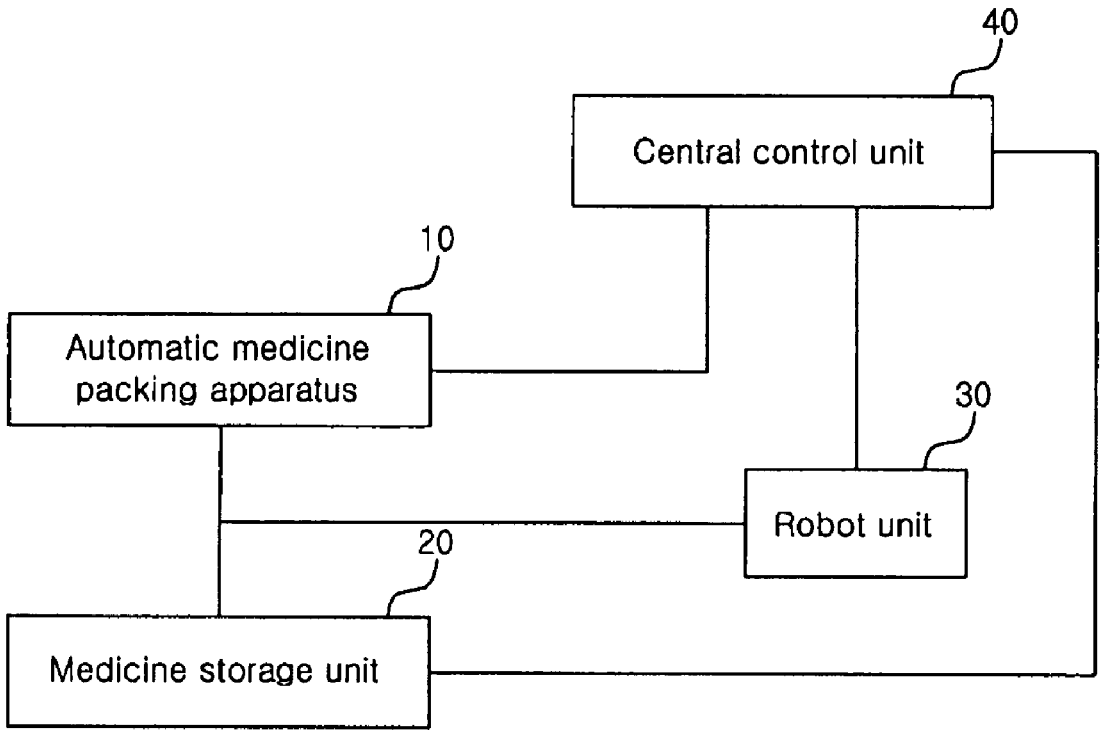
FIG. 1 is a block diagram illustrating a medicine management system according to an embodiment of the present invention.
Figure 2:
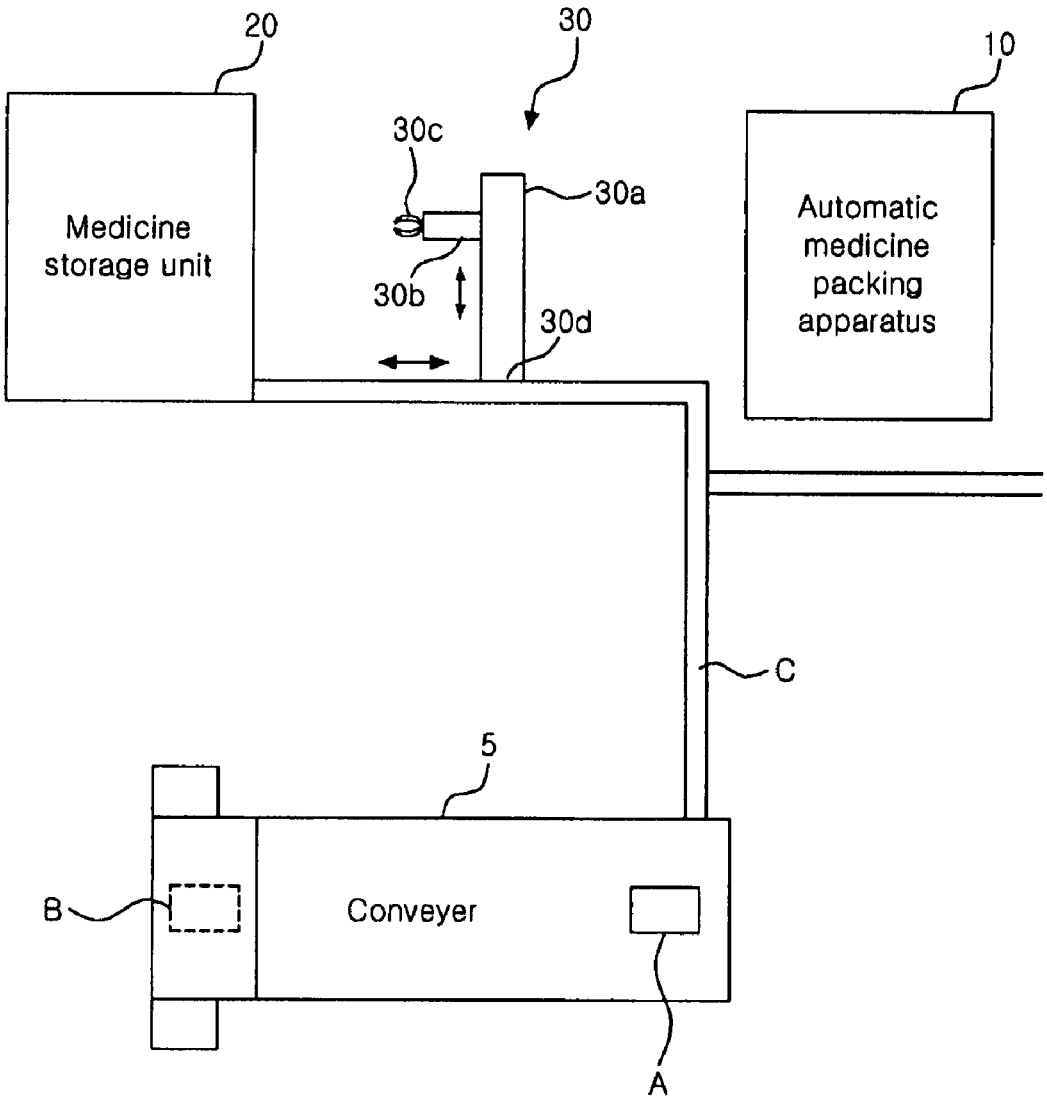
FIG. 2 is a view illustrating movement of a robot unit in the medicine management system shown in FIG. 1.
Figure 3:
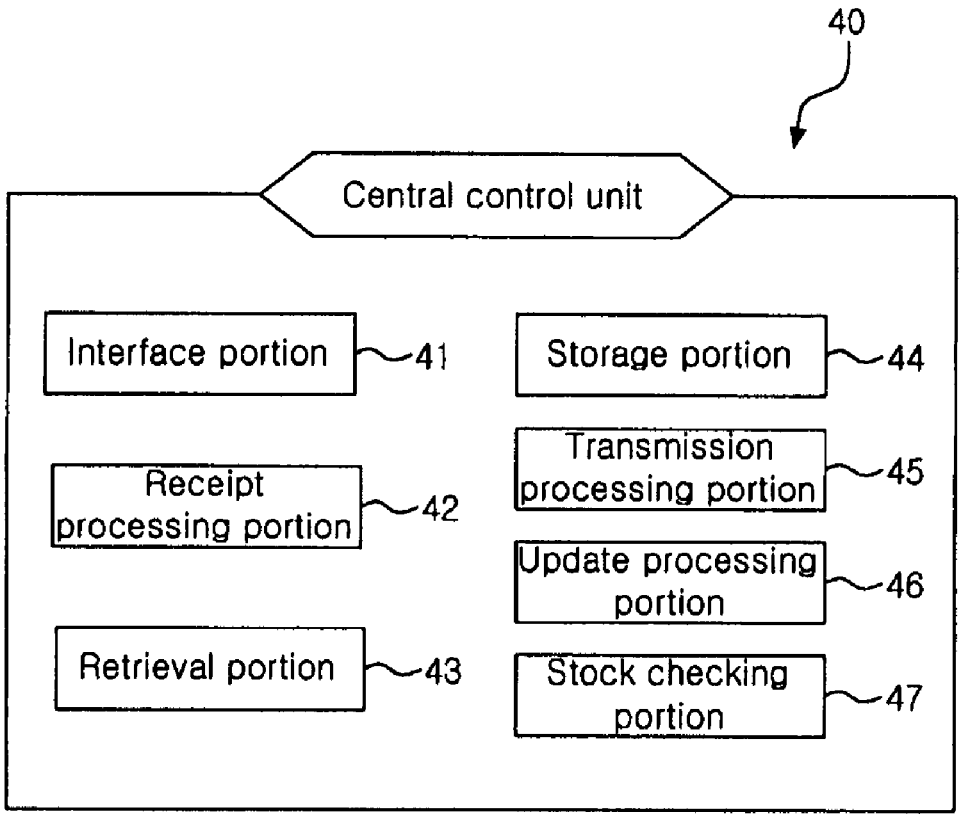
FIG. 3 is a block diagram illustrating a central control unit shown in FIG. 1.
Figure 4:
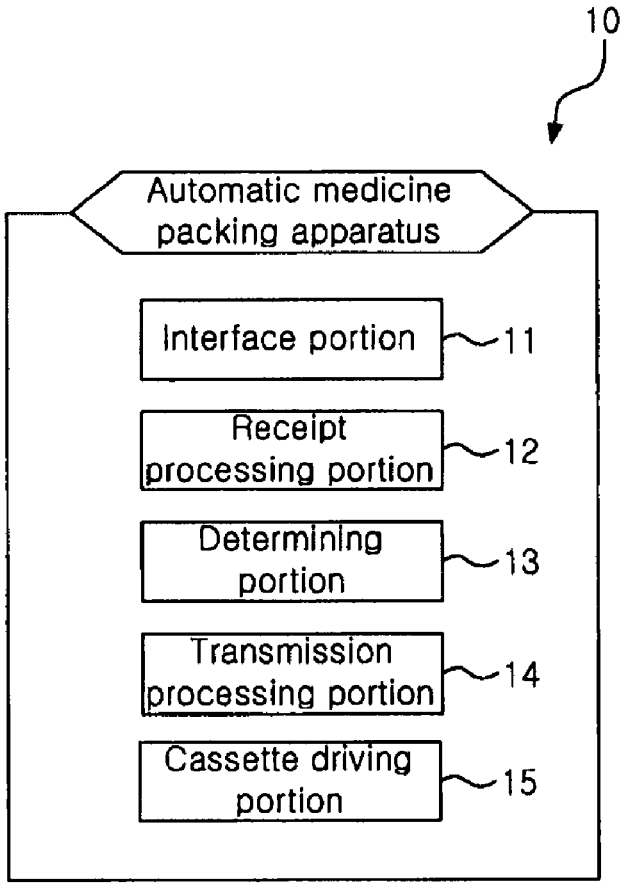
FIG. 4 is a block diagram illustrating an automatic medicine packing apparatus shown in FIG. 1.
Figure 5:
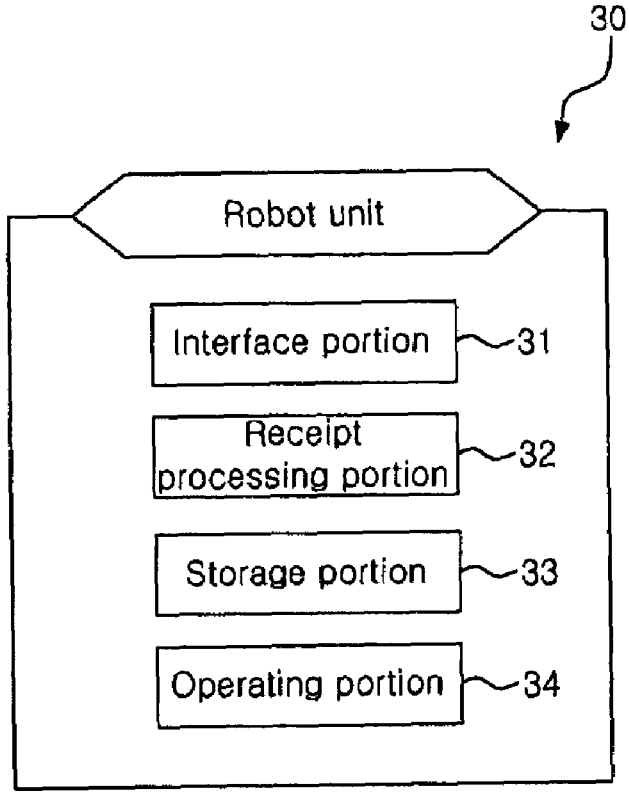
FIG. 5 is a block diagram illustrating the robot unit shown in FIG. 1.

FIG. 1 is a block diagram illustrating a medicine management system according to an embodiment of the present invention, FIG. 2 is a view illustrating movement of a robot unit in the medicine management system shown in FIG. 1, FIG. 3 is a block diagram illustrating a central control unit shown in FIG. 1, FIG. 4 is a block diagram illustrating an automatic medicine packing apparatus shown in FIG. 1, and FIG. 5 is a block diagram illustrating the robot unit shown in FIG. 1.

Referring to FIGS. 1 and 2, the medicine management system includes a medicine storage unit 20 for keeping at least one cassette in which medicines are accommodated, an automatic medicine packing apparatus 10 for packing medicines according to preparation request data and requesting replenishment of medicines when there is no medicine in the cassette, a robot unit 30 for gripping and transferring the cassette in which medicines are accommodated, and a central control unit 40 for communicating with the automatic medicine packing apparatus 10, the medicine storage unit 20 and the robot unit 30 and for controlling to mount a new cassette kept in the medicine storage unit 20 to the automatic medicine packing apparatus 10 using the robot unit 30 when there is no medicine in the cassette of the automatic medicine packing apparatus 10.

At this time, if the central control unit 40 receives a medicine replenishing request signal from the automatic medicine packing apparatus 10, the central control unit 40 transmits to the robot unit 30 movement control commands, including cassette information on the cassette requested to be replenished with the medicines, cassette information on the new cassette in which the corresponding medicines are accommodated, and position information on a conveyer 5.

Then, the robot unit 30 moves to the position of the automatic medicine packing apparatus 10 according to the movement control commands received from the central control unit 40, grips the corresponding cassette, and then transfers the gripped cassette to the conveyer 5. Thereafter, the robot unit 30 moves to the position of the medicine storage unit 20, grips a new cassette, moves to the position of the automatic medicine packing apparatus 10, and then mounts the gripped cassette thereto.

At this time, the robot unit 30 is moved along predetermined robot movement lines.

In one embodiment, the predetermined robot movement lines are orthogonal to each other, but the present invention is not limited thereto.

This robot unit 30 includes a body 30*a*, a robot arm 30*b*, a gripper 30*c* and moving means 30*d*.

The body 30*a* can be made of a metallic material. The shape of the body 30*a* is not limited to that shown in FIG. 2 but the body 30*a* may be modified with a variety of shapes.

The robot arm 30*b* is mounted to the body 30*a* to be movable at least upward and downward.

The gripper 30*c* includes means for gripping the cassettes, in which the medicines are accommodated and which are kept in the automatic medicine packing apparatus 10 and the medicine storage unit 20. At this time, the gripper 30*c* is configured to be capable of being rotated.

The moving means 30*d* moves along the predetermined robot movement lines, and for example, an automatic guided vehicle (AGV) is used as the moving means.

At this time, a storage portion 33 (FIG. 5) of the robot unit 30 stores predetermined moving coordinate information on the robot unit 30 and coordinate information on stop points through which the robot unit 30 should pass on a path for forwarding to its target point. As such, the moving means 30*d* moves along the robot movement lines based on the moving coordinate information stored in the storage portion 33.

The robot unit 30 which grips the cassette required to be replenished with the medicines from the automatic medicine packing apparatus 10 moves along a predetermined robot movement line C, then placing the cassette requested to be replenished with the medicines (hereinafter, referred to as "empty cassette") onto the conveyer 5. At this time, the empty cassette A placed onto the conveyer 5 is moved to a medicine replenishing center B, so that a pharmacist or manager fills the empty cassette with the corresponding medicines. A bar code for representing medicine information and cassette identification information is attached onto this empty cassette.

The medicine replenishing center B reads the medicine and cassette identification information on the empty cassette using a reader (not shown) for reading the bar code attached to the empty cassette, and transmits the read medicine and cassette identification information on the empty cassette to the central control unit 40, so that the information may be displayed on a screen of the central control unit 40. As such, the pharmacist or manager watches the medicine information displayed on the screen and fills the cassette with the corresponding medicines.

It is described in the present embodiment that the medicine and cassette identification information read from the reader is transmitted to the central control unit 40, but the present invention is not limited thereto. That is, instead of the medicine and cassette identification information read from the reader, the medicine and cassette identification information may be received through an input portion (not shown) provided in the central control unit 40 and displayed onto the screen.

Referring to FIG. 3, the central control unit 40 will be further described. The central control unit 40 includes an interface portion 41, a receipt processing portion 42, a retrieval portion 43, a storage portion 44, a transmission processing portion 45, an update processing portion 46 and a stock checking portion 47.

The interface portion 41 communicates with the automatic medicine packing apparatus 10, the medicine storage unit 20 and the robot unit 30 (FIG. 1).

The receipt processing portion 42 receives the medicine replenishing request signal from the automatic medicine packing apparatus 10 through the interface portion 41.

Furthermore, the receipt processing portion 42 receives the cassette identification information on the cassette in the automatic medicine packing apparatus 10 and the medicine information on the medicines which are accommodated in the cassette.

The retrieval portion 43 retrieves from the storage portion 44 the cassette information on the cassettes, in which the corresponding medicines are accommodated, according to the medicine replenishing request signal received by the receipt processing portion 42. At this time, the storage portion 44 stores the medicine information on the medicines which are kept in the medicine storage unit 20 and the cassette information (that is, cassette identification information and cassette position information) corresponding to the medicine information. The storage portion 44 also stores the cassette information (that is, cassette identification information and cassette position information) on the cassette in the automatic medicine packing apparatus 10, and the medicine information on the medicines which are accommodated in the cassette.

Then, the transmission processing portion 45 transmits the movement control commands, including the cassette information on the cassette in the automatic medicine packing apparatus 10 requested to be replenished with the medicines, the cassette information on the cassette in the medicine storage unit 20 retrieved from the storage portion 44, and the conveyer position information, to the robot unit 30 through the interface portion 41.

Furthermore, the transmission processing portion 45 transmits the preparation request date received from the pharmacist or manager to the automatic medicine packing apparatus 10.

If the cassette (hereinafter, referred to as "new cassette") in which the corresponding medicines are accommodated and which is kept in the medicine storage unit 20 is mounted according to the medicine replenishing request of the automatic medicine packing apparatus 10, the update processing portion 46 receives the cassette identification information on the new mounted cassette and updates the storage portion 44 with the received information.

After the new cassette which is kept in the medicine storage unit 20 is moved to the automatic medicine packing apparatus 10 through the robot unit 30, the stock checking portion 47 checks the stock of the medicine storage unit 20.

In detail, if the new cassette is mounted to the automatic medicine packing apparatus 10, the stock checking portion 47 deletes the cassette identification information on the cassette, which is transferred through the robot unit 30, from the storage portion 44 for storing the medicine information on the medicines which is kept in the medicine storage unit 20 and the cassette identification information on the cassettes in which the medicines are accommodated. As such, the stock of the medicine storage unit 20 can be easily checked.

After the robot unit 30 grips the empty cassette from the automatic medicine packing apparatus 10 to place the gripped empty cassette onto the conveyer 5 and grips the new cassette from the medicine storage unit 20 to mount the gripped new cassette to the automatic medicine packing apparatus 10, such a stock checking portion 47 checks the stock of the medicine storage unit 20.

It is described in the present embodiment that the stock is checked after the empty cassette in the automatic medicine packing apparatus 10 is replaced with the new cassette kept in the medicine storage unit 20, but the present invention is not limited thereto.

Referring to FIG. 4, the automatic medicine packing apparatus 10 will be further described. The automatic medicine packing apparatus 10 includes an interface portion 11, a receipt processing portion 12, a determining portion 13, a transmission processing portion 14 and a cassette driving portion 15.

The interface portion 11 communicates with the central control unit 40 (FIGS. 1 and 3).

The receipt processing portion 12 receives the preparation request data from the central control unit 40.

The determining portion 13 determines whether there are medicines in the cassette. At this time, the determining portion 13 determines whether a trouble takes place in the automatic medicine packing apparatus 10 as well as whether there are medicines in the cassette.

If there is no medicine in the cassette, the transmission processing portion 14 generates the medicine replenishing request signal and transmits it to the central control unit 40 through the interface portions 11 and 41 of the automatic medicine packing apparatus 10 and the central control unit 40, respectively.

The cassette driving portion 15 drives the cassette in which the corresponding medicines are accommodated according to the preparation request data received in the receipt processing portion 12. As such, the medicines corresponding to the preparation request data may be packed in the packing paper dose by dose.

Furthermore, the cassette driving portion 15 drives the predetermined cassette, but if the new cassette kept in the medicine storage unit 20 (FIGS. 1 and 2) is mounted to the automatic medicine packing apparatus 10 according to the medicine replenishing request signal, the cassette driving portion 15 drives the new mounted cassette. That is, if the preparation is requested after the new cassette is mounted, the cassette driving portion 15 drives the recently set cassette.

Referring to FIG. 5, the robot unit 30 will be further described. The robot unit 30 includes an interface portion 31, a receipt processing portion 32, the storage portion 33 and an operating portion 34.

The interface portion 31 communicates with the central control unit 40 (FIGS. 1 and 3).

The receipt processing portion 32 receives the movement control commands from the central control unit 40 through the interface portion 31. At this time, the movement control commands includes the cassette information on the cassette requested to be replenished with the medicines, the cassette information on the new cassette in which the corresponding medicines is accommodated and which is kept in the medicine storage unit 20 (FIGS. 1 and 2), and the conveyer position information.

The storage portion 33 stores the moving coordinate information for the robot unit 30 to move along the robot movement line C (FIG. 2), and the coordinate information on the stop points through which the robot unit 30 should pass on the path for forwarding to the target point.

Herein, the coordinate information on the stop points comprises coordinate information on a stop point to be positioned in the automatic medicine packing apparatus 10 (FIGS. 1, 2, and 4) in order to grip the empty cassette, coordinate information on a stop point to be positioned in order to place the empty cassette onto the conveyer 5 (FIG. 2), and coordinate information on a stop point to be positioned in the medicine storage unit 20 in which the new cassette to be mounted to the automatic medicine packing apparatus 10 is kept.

According to the movement control commands received in the receipt processing portion 32, the operating portion 34 moves to the position of the automatic medicine packing apparatus 10, and then, allows the robot arm 30*b* (FIG. 2) to be moved to the position of the empty cassette, thereby gripping the empty cassette and transferring the gripped empty cassette to the conveyer 5.

Then, the operating portion 34 moves to the medicine storage unit 20 to grip the new cassette in which the corresponding medicines are accommodated, moves to the corresponding position of the automatic medicine packing apparatus 10, and then controls the robot arm 30*b* to a cassette mounting position, thereby mounting the corresponding cassette.

Figure 6:
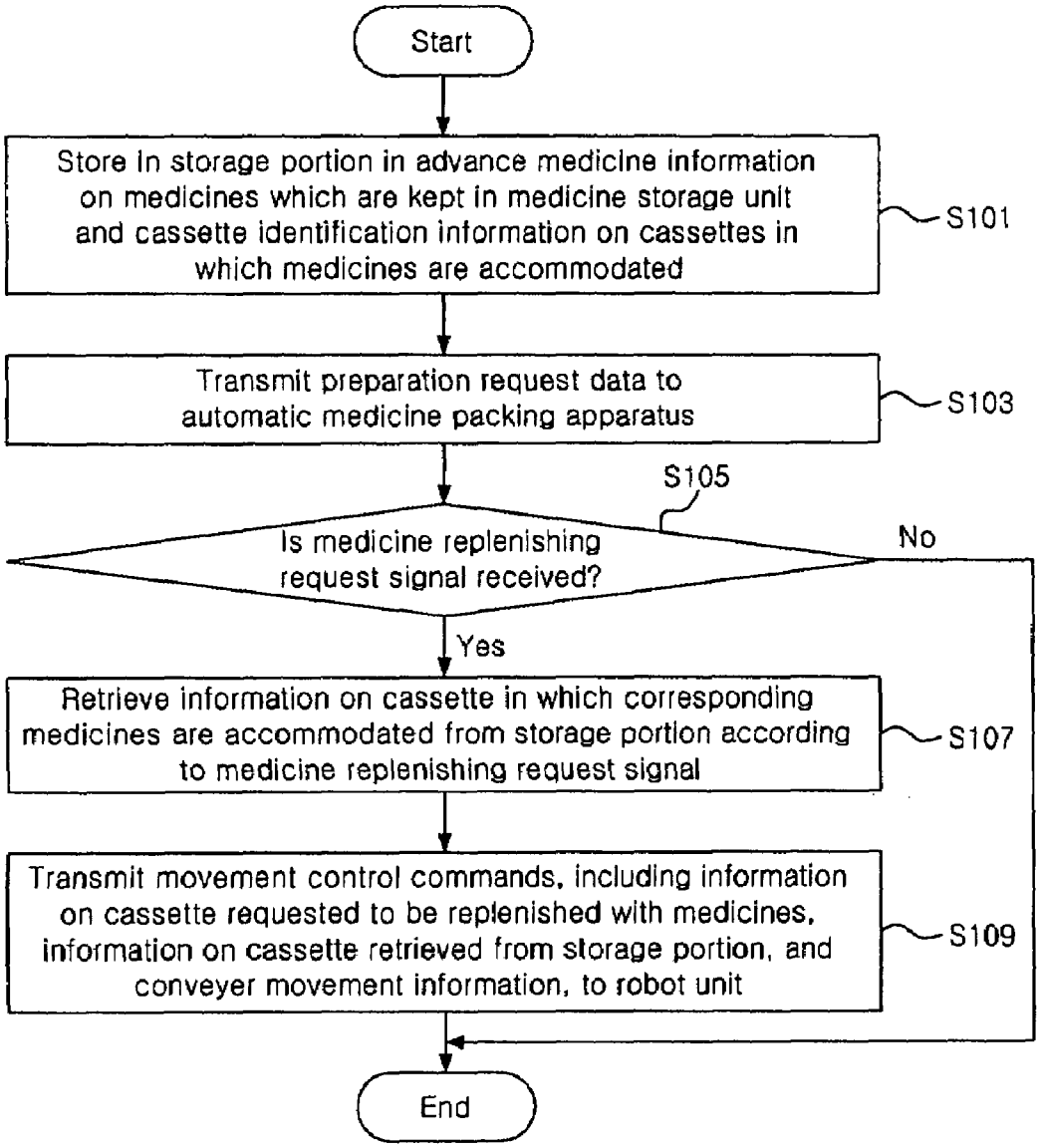
FIG. 6 is an operational flow chart illustrating a processing method of a medicine management system according to an embodiment of the present invention.

A processing method of the medicine management system as constructed above will be described with reference to FIG. 6 as follows.

The central control unit 40 allows the medicine information on the medicines which are kept in the medicine storage unit 20 and the cassette identification information on the cassettes in which the medicines are accommodated to be stored in the storage portion 44 in advance (S101).

Then, the central control unit 40 transmits the preparation request data received from the pharmacist or manager to the automatic medicine packing apparatus 10 (S103). At this time, the automatic medicine packing apparatus 10 drives the cassette in which the corresponding medicines are accommodated according to the preparation request data received from the central control unit 40. As such, the medicines corresponding to the preparation request data can be packed in the medicine packing paper dose by dose.

Then, the central control unit 40 determines whether or not the medicine replenishing request signal is received from the automatic medicine packing apparatus 10 (S105).

If the determination of the step S105 results in that the medicine replenishing request signal is not received from the automatic medicine packing apparatus 10, the central control unit 40 terminates the process.

If the determination of the step S105 results in that the medicine replenishing request signal is received from the automatic medicine packing apparatus 10, the central control unit 40 retrieves the cassette information on the cassette in which the corresponding medicines are accommodated from the storage portion 44 according to the received medicine replenishing request signal (S107). At this time, the cassette information to be retrieved corresponds to the information on the new cassette which is kept in the medicine storage unit 20.

Then, the central control unit 40 transmits the movement control commands, including the cassette information on the cassette in the automatic medicine packing apparatus 10 requested to be replenished with the medicines, the cassette information on the new cassette in the medicine storage unit 20 retrieved from the storage portion 44, and the conveyer position information, to the robot unit 30 (S109).

It is described in the present embodiment that the movement control commands, including the cassette information on the cassette requested to be replenished with the medicines, the cassette information on the cassette retrieved from the storage portion 44 and the conveyer position information on the conveyer 5, are transmitted to the robot unit 30, but the present invention is not limited thereto. If the conveyer position information of the conveyer 5 is previously stored in the robot unit 30 and the moving sequence thereof is also stored in advance, the movement control commands, including the cassette information on the cassette requested to be replenished with the medicines and the cassette information on the cassette retrieved from the storage portion 44, can be transmitted to the robot unit 30.

Accordingly, when the replenishment of medicine is requested, the new cassette in which the corresponding medicines are accommodated may be easily mounted to the automatic medicine packing apparatus 10 using the robot unit 30.

Figure 7:
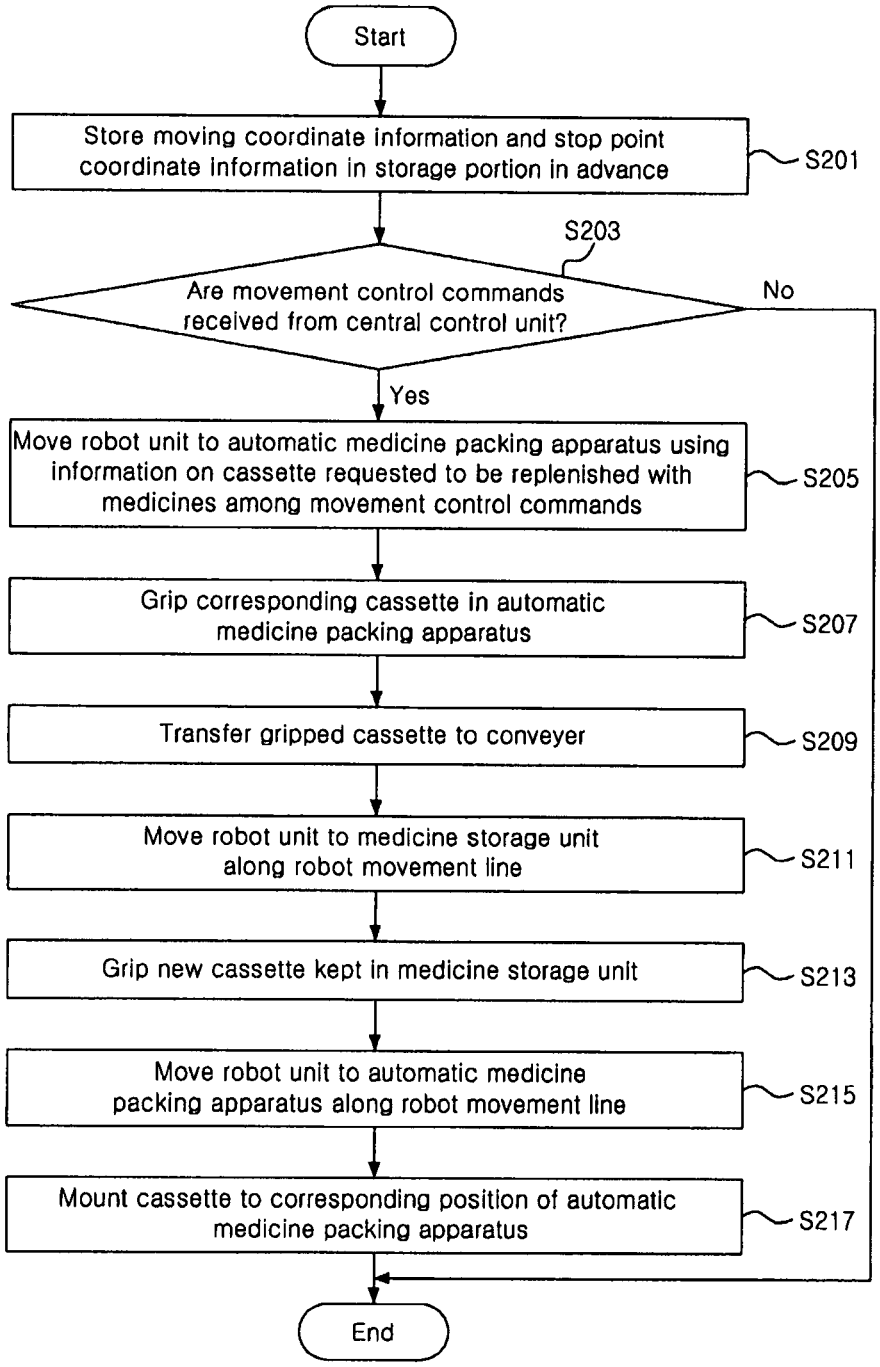
FIG. 7 is an operational flow chart illustrating an operation processing method of the robot unit of a medicine management system according to an embodiment of the present invention is applied.

An operation processing method of the robot unit 30 which is applied to the medicine management system as described above will be described with reference to FIG. 7 as follows.

The robot unit 30 allows the moving coordinate information and the coordinate information on the stop points to be stored in the storage portion 33 in advance (S201).

Then, the robot unit 30 determines whether or not the movement control commands, including the cassette information on the cassette requested to be replenished with the medicines, the cassette information on the cassette retrieved from the storage portion 44, and the conveyer position information on the conveyer 5, are received from the central control unit 40 (S203).

If the determination of the step S203 results in that the movement control commands are not received from the central control unit 40, the robot unit 30 terminates the process after a standby state is maintained for a predetermined time. That is, the robot unit 30 determines whether a robot operation completion signal is inputted from the pharmacist or manager. At this time, the robot operation is finished if the completion of the robot operation is requested, while the standby state is maintained for the predetermined time if the robot operation completion signal is not received.

If the determination of the step S203 results in that the movement control commands are received from the central control unit 40, the robot unit 30 moves along the predetermined robot movement line to the automatic medicine packing apparatus 10 using the cassette information on the cassette requested to be replenished with the medicines among the received movement control commands (S205).

Then, the robot unit 30 moves the robot arm 30*b* to the position of the cassette requested to be replenished with the medicines, and grips the corresponding cassette in the automatic medicine packing apparatus 10 with the gripper 30*c* (S207).

Thereafter, the robot unit 30 transfers the gripped cassette to the conveyer 5 along the predetermined robot movement line using the conveyer position information received from the central control unit 40 (S209). At this time, the robot movement line is a moving path corresponding to the moving coordinate information which in stored in the storage portion 33 in advance. Furthermore, the cassette placed onto the conveyer 5 is moved to the medicine replenishing center B.

Then, after the cassette requested to be replenished with the medicines is transferred to the conveyer 5, the robot unit 30 moves to the medicine storage unit 20 along the predetermined robot movement line using the new cassette information received from the central control unit 40 (S211).

Next, after the robot unit 30 moves the robot arm 30*b* to the position of the new cassette, in which the corresponding medicines are accommodated, in the medicine storage unit 20, the gripper 30*c* of the robot unit 30 grips the new cassette (S213).

Thereafter, the robot unit 30 moves to the automatic medicine packing apparatus 10 along the predetermined robot movement line (S215).

Then, after the robot unit 30 moves the robot arm 30*b* to the position to which the new cassette is mounted in the automatic medicine packing apparatus 10, the robot unit 30 mounts the new cassette to the automatic medicine packing apparatus 10 (S217). That is, in the position to which the robot arm 30*b* is moved, the new cassette is caused to be mounted to the automatic medicine packing apparatus 10.

If the new cassette in which the medicines are accommodated and which is kept in the medicine storage unit 20 is mounted to the automatic medicine packing apparatus 10 through the robot unit 30 as described above, the central control unit 40 receives a medicine replenishing completion signal from the automatic medicine packing apparatus 10 to check the stock of the medicine storage unit 20 according to the received medicine replenishing completion signal.

Furthermore, the central control unit 40 receives the cassette identification information on the new cassette mounted to the automatic medicine packing apparatus 10 to update the storage portion 44 therewith.

Accordingly, using the robot unit, the empty cassette is easily replaced with the new cassette in which the medicines are accommodated in the automatic medicine packing apparatus.

It is described in the present embodiment that the movement control commands, including the cassette information on the cassette requested to be replenished with the medicines, the new cassette information on the new cassette in the medicine storage unit, and the conveyer position information, are transmitted from the central control unit to the robot unit. However, in another embodiment, the movement control commands, including the cassette information on the cassette requested to be replenished with the medicines, the new cassette information on the new cassette in the medicine storage unit, and the conveyer position information, may be transmitted from the central control unit 40 to the robot unit 30 one by one with predetermined time intervals.

According to one embodiment of the present invention, using the robot unit 30, after moving an empty cassette of an automatic medicine packing apparatus, a new cassette in which the corresponding medicines are accommodated and which is kept in the medicine storage unit 20 is mounted to the automatic medicine packing apparatus 10, whereby the replenishment of the medicines can be conveniently implemented.

Further, in one embodiment of the present invention as described above, a bar code attached to the cassette is read, so that it can be easily understood which medicines are accommodated in the cassette.

Furthermore, according to one embodiment of the present invention, after the new cassette in which the corresponding medicines are accommodated and which is kept in the medicine storage unit is mounted to the automatic medicine packing apparatus, a medicine replenishing completion signal is received, so that the stock of the medicine storage unit 20 can be easily checked.

In addition, according to the present invention, new cassette identification information on the new cassette mounted according to the medicine replenishing request of the automatic medicine packing apparatus 10 is received, so that a storage portion can be updated with the new cassette identification information.

The scope of the present invention is not limited to the embodiments described. It will be apparent that those skilled in the art can make various modifications and changes thereto. The modifications and changes are contained in the spirit and scope of the present invention defined by the appended claims.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A medicine management system, comprising:

a medicine storage unit storing at least one new cassette in which medicines are accommodated;

an automatic medicine packing apparatus having a receipt processing portion, a determining portion, a transmission processing portion, and a plurality of dispensing cassettes each having a medicine stored therein, the dispensing cassettes being mounted to a plurality of cartridges and configured to dispense medicines to be packed according to an external preparation request data received by the receipt processing portion, the transmission processing portion transmitting a medicine replenishment request signal when the determining portion determines one of the dispensing cassettes is empty;

a robot unit moving along a predetermined robot movement line and including a gripper for gripping the new cassette and the dispensing cassette, respectively;

a central control unit operable to transmit movement control commands to the robot unit when the transmission processing portion of the automatic medicine packing apparatus generates and transmits the medicine replenishment request signal to the central control unit, the central control unit transmitting movement control commands to the robot unit corresponding to the medicine replenishment request signal to mobilize the robot unit, the robot unit gripping the empty dispensing cassette requested to be replenished from the automatic medicine packing apparatus and transferring it to a conveyer and gripping a new cassette in which the corresponding medicines are accommodated in the medicine storage unit, and transferring and mounting the new cassette to the automatic medicine packing apparatus, in response to the movement control commands.

2. The medicine management system as claimed in claim 1 wherein a bar code for representing medicine information and cassette identification information is attached to the dispensing cassette and the new cassette.

3. The medicine management system as claimed in claim 1 wherein the central control unit includes a storage portion operable to store medicine information for the medicines stored in the medicine storage unit and cassette identification information for the new cassettes in which the medicines are accommodated, an interface portion communicating with the automatic medicine packing apparatus, the medicine storage unit and the robot unit, a receipt processing portion operable to receive the medicine replenishment request signal from the transmission processing portion of the automatic medicine packing apparatus, a retrieval portion operable to receive the cassette information on the new cassette, in which the corresponding medicines are accommodated, from the medicine storage portion according to the received medicine replenishment request signal, and a transmission processing portion operable to transmit the movement control commands, including the cassette information for the dispensing cassette requested to be replenished with the medicines, the cassette information for the new cassette retrieved from the storage portion, and conveyer position information, to the robot unit through the interface portion.

4. The medicine management system as claimed in claim 1 wherein the central control unit further includes an update processing portion operable to update the storage portion with new cassette identification information for the new cassette to be mounted according to the medicine replenishment request signal originating from the automatic medicine packing apparatus.

5. The medicine management system as claimed in claim 1 wherein the central control unit further includes a stock checking portion operable to check a stock of the medicine storage unit after the new cassette in which the medicines are accommodated and which is kept in the medicine storage unit is mounted to the automatic medicine packing apparatus by the robot unit.

6. The medicine management system as claimed in claim 1, further comprising:

a medicine replenishing center to which the conveyor leads for delivering the empty dispensing cassette, the central control unit including a screen, the medicine replenishing center transmitting medicine and cassette identification information of the empty dispensing cassette to the central control unit to display the medicine and cassette identification information on the screen.

7. A medicine management system, comprising:

a medicine storage unit housing at least one new cassette in which medicines are accommodated;

an automatic medicine packing apparatus having a plurality of dispensing cassettes containing a plurality of medicines, respectively, the automatic medicine packing apparatus operable to pack medicines according to a preparation request data externally received and request replenishment of medicines when there is no medicine in the respective dispensing cassettes, the automatic medicine packing apparatus configured such that the plurality of dispensing cassettes are arranged in and mounted to a plurality of cartridges configured to be intermittently controlled, respectively, the medicines prescribed dose by dose being discharged through respective passages formed in the cartridges, the medicines discharged from the cartridges collected to a hopper, and the medicines collected to the hopper being discharged to the bottom side of the hopper and packed by a packing device and packing paper;

a robot unit operable to move along a predetermined robot movement line in order to advance toward the medicine storage unit, the automatic medicine packing apparatus and a conveyor, and to grip respective empty dispensing cassettes required to be replenished with corresponding medicines and the new cassette stored in the medicine storage unit;

a medicine replenishing center for reading medicine and cassette identification information on the empty dispensing cassette using a reader operable to read a bar code attached to the empty dispensing cassette, and transmit the read medicine and cassette identification information; and a central control unit operable to control the robot unit and transmit movement control commands to the robot unit when the automatic medicine packing apparatus requests the empty dispensing cassettes to be replenished with corresponding medicines such that an empty dispensing cassette requested to be replenished is gripped in the automatic medicine packing apparatus and transferred to the conveyer, and the new cassette in which the corresponding medicines are accommodated is gripped in the medicine storage unit and mounted to the automatic medicine packing apparatus, the central control unit displaying medicine and cassette identification information of the empty dispensing cassette received from the medicine replenishing center on a screen.

8. The medicine management system as claimed in claim 7 wherein the central control unit includes a storage portion storing medicine information for the medicines stored in the medicine storage unit and cassette identification information for the new cassette in which the medicines are accommodated, an interface portion communicating with the automatic medicine packing apparatus, the medicine storage unit and the robot unit, a receipt processing portion operable to receive the medicine replenishment request signal from the automatic medicine packing apparatus, a retrieval portion operable to receive the cassette information on the new cassette, in which the corresponding medicines are accommodated, from the medicine storage portion according to the received medicine replenishment request signal, and a transmission processing portion operable to transmit the movement control commands, including the cassette information for the dispensing cassette requested to be replenished with the medicines, the cassette information for the new cassette retrieved from the storage portion, and conveyer position information, to the robot unit through the interface portion.

9. The medicine management system as claimed in claim 7 wherein the central control unit further includes an update processing portion operable to update the storage portion with new cassette identification information for the new cassette to be mounted according to the medicine replenishment request of the automatic medicine packing apparatus.

10. The medicine management system as claimed in claim 7 wherein the central control unit further includes a stock checking portion operable to check a stock of the medicine storage unit after the new cassette in which the medicines are accommodated and which is kept in the medicine storage unit is mounted to the automatic medicine packing apparatus by the robot unit.

11. The medicine management system as claimed in claim 7 wherein the automatic medicine packing apparatus includes a determining portion for determining whether or not there are medicines in the respective dispensing cassettes, and a transmission processing portion for generating the medicine replenishing request signal and transmitting it to the central control unit through the interface portion when there is no medicine in the respective dispensing cassettes.

* * * * *